US005237335A

United States Patent [19]

Tsuchida

[11] Patent Number: 5,237,335

[45] Date of Patent: Aug. 17, 1993

[54] WHIP ANTENNA FOR USE IN VEHICLES

[75] Inventor: Heizo Tsuchida, Kanagawa, Japan

[73] Assignee: Harada Kogyo Kabushiki Kaisha, Tokyo, Japan

[21] Appl. No.: 824,723

[22] Filed: Jan. 17, 1992

Related U.S. Application Data

[63] Continuation of Ser. No. 501,671, Mar. 29, 1990, abandoned.

[30] Foreign Application Priority Data

Mar. 30, 1989 [JP] Japan ..... 1-35555

[51] Int. Cl.[5] ..... H01Q 1/32; H01Q 9/30

[52] U.S. Cl. ..... 343/715; 343/900

[58] Field of Search ..... 343/715, 713, 906, 900, 343/888, 702; 439/916; 174/138 A, 152 A, 153 A

[56] References Cited

U.S. PATENT DOCUMENTS

| | | | |
|---|---|---|---|
| 2,536,733 | 1/1951 | Finke et al. | 343/888 |
| 2,697,785 | 12/1954 | Stewart | 343/888 |
| 3,444,313 | 5/1969 | Goodchild, Jr. et al. | 343/888 |
| 3,852,757 | 12/1974 | Kaiser | 343/888 |
| 3,977,005 | 8/1976 | Cejka | 343/715 |
| 4,101,898 | 7/1978 | Ingram | 343/715 |
| 4,152,705 | 5/1979 | Kowols | 343/715 |

*Primary Examiner*—Rolf Hille
*Assistant Examiner*—Hoanganh Le
*Attorney, Agent, or Firm*—Koda and Androlia

[57] ABSTRACT

A whip antenna for vehicles including a feeder terminal directly coupled to the base of the whip antenna element. The coupled portion is inserted into a cylindrical attachment base, and the cylindrical attachment base is filled with an insulating material so that the insulating material envelopes the entire coupled portion with the pointed tip end of the feeder terminal exposed from the insulating material.

3 Claims, 2 Drawing Sheets

WHIP ANTENNA FOR USE IN VEHICLES

This is a continuation of application Ser. No. 501,671, filed Mar. 29, 1990 now abandoned.

BACKGROUND OF THE INVENTION

1. Field of the Invention

The present invention relates to a whip antenna used with vehicles and more particularly to an attachment structure for the whip antenna.

2. Prior Art

Many different types of antennas are used with automobile radio receivers. Among them, single-length whip antennas can be manufactured inexpensively and performs well; that is they have good reception, a minimum requirement for antennas.

A single-length whip antenna normally includes an antenna element which is formed from a single, continuous rod-shape conductive material. The antenna element is designed to be matched more or less to a quarter wavelength of the FM band.

When the antenna is installed on a vehicle body, the antenna element remains outside of the vehicle body. Accordingly, in order to ensure that the antenna element will withstand load caused by obstacles during operation of the vehicle and or when the vehicle is washed, a material having high tensile strength and high recovery properties (such as stainless steel) is used.

Furthermore, the antenna is mounted to the vehicle body by securing the antenna element with screws to an attachment base which has been installed on the wall of the vehicle body. In this case, since the whip antenna element is formed from a high tensile material, workability (that is, machinability, etc.) is usually poor. As a result, it is difficult to cut thread thereon; thus, it is difficult to connect the antenna element to the attachment base with screws. Therefore, a special connecting means such as joint is usually interposed between the whip antenna element and the attachment base.

FIG. 2 shows a typical example of such a prior art arrangement. A joint (first joint) 2 is mounted on the base of a whip antenna element 1, and a male screw 3 projects from the bottom of the joint 2. Another joint (second joint) 6 is coaxially inserted in the top end of a cylindrical attachment base 4 via an insulator 5. A female screw 7 which engages with the male screw 3 is formed at the center of the second joint 6. A feeder terminal 8 is formed on the lower end of the second joint 6 so that the terminal 8 projects from the insulator 5 and is connected to a connector (not shown) on a feeder (not shown). A male screw 9 is formed on the outer surface of the upper portion of the attachment base 4 so that the base 4 can be screwed to the vehicle body.

FIG. 3 illustrates another example of the prior art. In this example, a female screw 10 is formed in the first joint 2 and a male screw 11 projects from the second joint 6. In all other aspects, the structure is exactly the same as that shown in FIG. 2, and the whip antenna element 1 and attachment base 4 are coupled together via the joints 2 and 6.

However, the above-described whip antennas have several disadvantages in that in order to insure workability, it is necessary that the joints be made of a material which has a lower tensile strength than the whip antenna element 1. However, the material must also be strong enough to withstand load.

Another greater problem is that even if a material is used for the joints which is adequate in terms of strength, the dimensions of the male screw (3 and 11) cannot be very large, since the screw coupling must be in a limited (relatively small) space. As a result, if the load which bends the whip antenna element 1 in the direction indicated by the arrows in FIGS. 2 and 3 is concentrated at the screws, the root portion of the male screws (3 and 11) may bend or break.

In view of the desirability of having as large space as possible during transport of the vehicles, it is desirable that whip antenna be detachable from the vehicle body. Except for this reason (to conserve space), there is no other reason for the antenna to be detachable from the vehicle body. Particularly, it is not absolutely necessary that the whip antenna element and attachment base be separated from each other and these components may be formed as an integral unit. In fact, such an arrangement has been employed.

SUMMARY OF THE INVENTION

Accordingly, the object of the present invention is to provide a whip antenna for a vehicle wherein the whip antenna element is connected to an attachment base and is not removed from the attachment base. Thus, the strength of the connection between the antenna element and the attachment base is sufficiently great so that there is no danger of breakage or bending, even if the load applied to the whip antenna element is concentrated at the connection area.

It is also another object of the present invention to provide a whip antenna which has a simple structure and requires only a small number of components.

In order to accomplish these objects, the present invention employs a unique structure wherein: (a) a feeder terminal is directly coupled to the base of a whip antenna element, (b) the coupled portion is placed in the central area of a cylindrical attachment base, and (c) the cylindrical attachment base is filled with an insulating material which is hardened so that the material envelops the coupled portion entirely except for the tip of the feeder terminal.

With this structure, the base of the whip antenna element is installed in the cylindrical attachment base upright, and the base part is embedded in an insulating material such as a resin, etc. Accordingly, the connection between the antenna element and attachment base is strong enough to prevent breakage or bending, even if the load applied to the antenna element is concentrated at the coupled portion. Also, the feeder terminal is directly connected to the whip antenna element without using a special type of joint as in conventional antennas. Accordingly, the structure of the antenna of the present invention is simple, and the number of components is less.

DETAILED DESCRIPTION OF THE INVENTION

Figure 1:
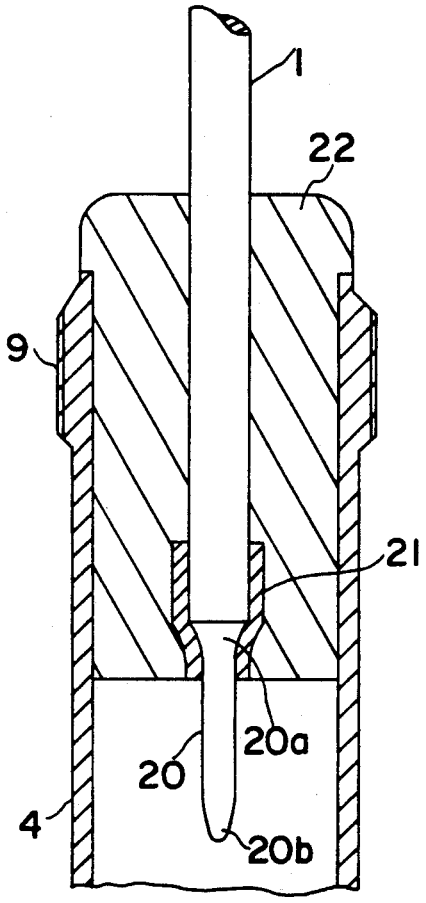
FIG. 1 is a partial longitudinal sectional view of the whip antenna of the present invention.
Figure 2:
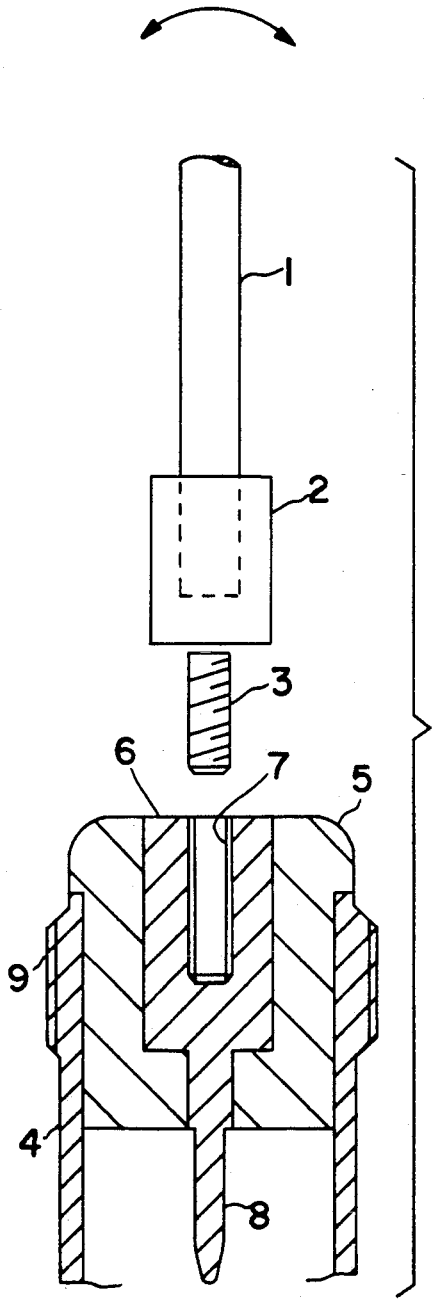
FIG. 2 PRIOR ART
FIGS. 2 and 3 are partially sectional side views showing structures of conventional whip antennas.
Figure 3:
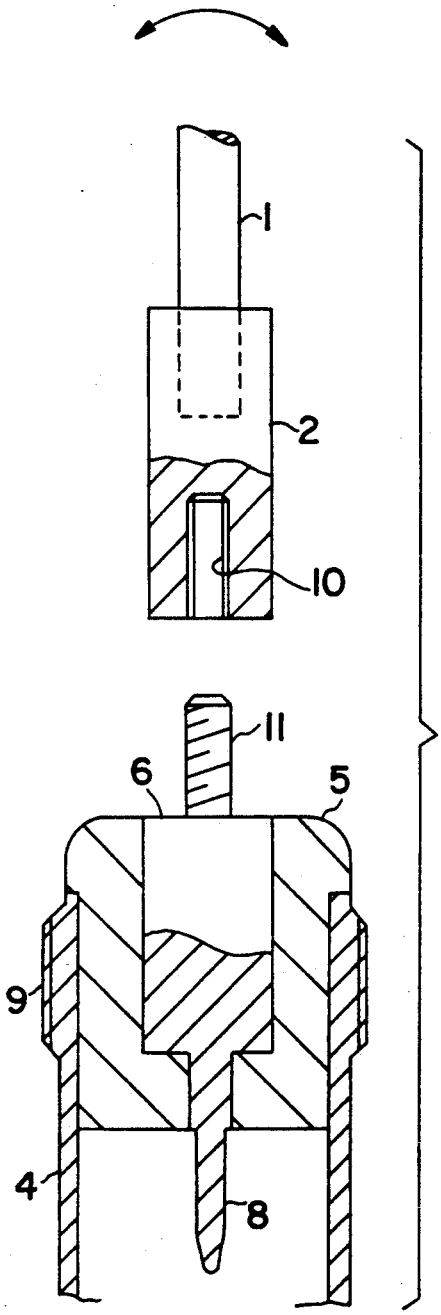
FIG. 3 PRIOR ART

One embodiment of the present invention will be described with reference to FIG. 1, and elements which are the same as in FIG. 2 and 3 are numbered with the same symbols.

In the Figures, a whip antenna element 1 is formed from, for example, a single high tensile strength stainless steel rod. The whip antenna element 1 may be formed with a multiple number of conductive pipes which are connected so that the pipes are free to slide relative to each other.

A feeder terminal 20 is coupled to the base end of the whip antenna element 1. The end portion 20*a* of the feeder terminal 20 which comes in contact with the base end of the whip antenna element 1 has a large-diameter head 20*a*. The opposite end portion 20*b* of the feeder terminal 20 is pointed so that it can easily be connected to a connector (not shown).

A conductive connecting assembly 21 is formed in the shape of a hopper at its lower half and mounted around the portion where the feeder terminal 20 is coupled to the base end of the whip antenna element 1 (such a "portion" is called "coupled portion" hereinafter). The inner surface of the wall of the connecting assembly 21 is, for example, spot-welded to the whip antenna element 1. Thus, the whip antenna element 1, connecting assembly 21 and feeder terminal 20 are joined into an integral and single unit both electrically and mechanically.

The portion where the whip antenna element 1 is coupled to the feeder terminal 20 (or the coupled portion) is concentrically inserted into a central portion of the cylindrical attachment base 4 in a manner that the coupled portion does not contact the attachment base 4. The interior of the attachment base 4 is filled with an insulating material 22, e.g., a resin which has electrical insulating characteristics, and the resin 22 is hardened so that it envelops the coupled portion which is inserted except for the shank and sharp pointed end 20*b* of the feeder terminal 20.

The attachment base 4 is filled so that the connecting assembly 21 is completely embedded in the resin 22. Thus, the whip antenna element 1 and feeder terminal 20 are secured in the attachment base 4 and electrically insulated.

In the present invention, since the base end of the whip antenna element 1 is installed inside the cylindrical attachment base 4 upright and embedded in the resin 22, external force applied to the antenna element 1 is not concentrated at a single area inside the attachment base 4. Furthermore, the bending resistance of the whip antenna element 1 can be utilized to its advantage. Thus, even if a great amount of external force is applied to the whip antenna element 1, there is no danger that the joint area between the antenna element 1 and the attachment base will bend or break.

The upper area of the coupled portion between the base end of the whip antenna element 1 and the feeder terminal 20, (i.e., the portion consisting of the head part 20*a* of the feeder terminal 20 and the cylindrical part of the connecting assembly 21), is larger in diameter than the lower area of the coupled portion, and this large-diameter portion is embedded in the resin 22. Accordingly, there is no danger that the feeder terminal 20 or the connecting assembly 21 will slip out of the resin 22. Furthermore, the feeder terminal 20 can be directly coupled to the whip antenna element 1 without the need for any special type of joint means as in conventional antennas. Thus, the structure of the antenna of the present invention is simpler than the structure of the prior art, the need for high-cost parts is eliminated, and the antenna is less costly to manufacture.

The present invention is not limited to the above-described embodiment. In this embodiment, the connecting assembly 21, a separate element from the feeder terminal 20, is used to connect the whip antenna element 1 to the feeder terminal 20. However, it is possible to use a feeder terminal which has an integrated connecting assembly 21 to form a single unit. In addition, in the above embodiment the attachment base 4 has no special indentations or projections in the wall. If necessary, however, it would be possible to form holes, etc., in the wall of the attachment base 4 and harden the resin 22 inside these holes so that the adhesion of the resin 22 to the attachment base 4 is increased. It goes without saying that various other modifications may be made without departing from the spirit of the present invention.

As described in detail, according to the present invention, a feeder terminal is directly coupled to the base of the whip antenna element, and the coupled portion is inserted into a cylindrical attachment base, and then this cylindrical attachment base is filled with an insulating material which is hardened so that the insulating material envelops the coupled portion except for the tip of the feeder terminal. As a result, the coupled portion is strong and there is no danger of breakage or bending even if a great amount of load should be concentrated on the joint area. In addition, the antenna is simple in structure and requires only a small number of components.

I claim:

1. A whip antenna for a vehicle comprising:

a rod like antenna element;

a feeder terminal having a pointed end and an enlarged head, said feeder terminal being formed integrally with said rod like antenna element;

an electrically conductive connecting means covering, surrounding and being electrically coupled to not only an end of said rod like antenna element but also said enlarged head of said feeder terminal; and an attachment base for mounting said whip antenna to a vehicle body in which said end of said antenna, said feeder terminal and said connecting means are installed, inside of said attachment base being filled with an insulating material which surrounds said antenna element, connecting means and feeder terminal and said pointed end of said feeder terminal being exposed from said insulating material.

2. A whip antenna according to claim 1 wherein said electrically conductive connecting means is spot welded to at least one of said rod like antenna element and said feeder terminal.

3. A whip antenna according to claim 1 wherein said electrically conductive connecting means has a bore provided therethrough of varying diameter, said diameter varying in accordance with a diameter of said rod like antenna element and said feeder terminal whereby an inner surface of said bore conforms to and engages with both said end of said rod like antenna element and said enlarged head of said feeder terminal.

* * * * *